United States Patent [19]

Gee

[11] Patent Number: 4,575,959

[45] Date of Patent: Mar. 18, 1986

[54] MATERIAL DIRECTING DEVICE FOR AN AUGER SCRAPER

[75] Inventor: James E. Gee, Washington, Ill.

[73] Assignee: Caterpillar Tractor Co., Peoria, Ill.

[21] Appl. No.: 605,542

[22] Filed: Apr. 30, 1984

[51] Int. Cl.[4] ..... E02F 3/62

[52] U.S. Cl. ..... 37/4; 198/671; 414/526

[58] Field of Search ..... 37/4, 8; 198/657, 662, 198/671, 674, 675, 676, 677, 213; 414/526

[56] References Cited

U.S. PATENT DOCUMENTS

| | | | |
|---|---|---|---|
| 2,330,113 | 9/1943 | Daniels | 37/4 X |
| 2,564,486 | 8/1951 | MacDonald | 37/4 X |
| 2,626,469 | 1/1953 | Armington | 37/8 X |
| 3,059,791 | 10/1962 | Stratton | 414/526 |
| 3,574,960 | 4/1971 | Peterson et al. | 37/4 |
| 3,722,114 | 3/1973 | Knell et al. | 37/4 |
| 3,857,190 | 12/1974 | Gee et al. | 37/8 |
| 3,859,741 | 1/1975 | Reinhardt | 37/8 |
| 3,885,332 | 5/1975 | Holland | 37/4 X |
| 4,167,825 | 9/1979 | Gee et al. | 37/4 |
| 4,456,305 | 6/1984 | Yoshikawa | 198/657 X |

*Primary Examiner*—Edgar S. Burr
*Assistant Examiner*—James R. McDaniel
*Attorney, Agent, or Firm*—Ralph E. Walters

[57] ABSTRACT

A scraper has a bowl and a floor and is constructed to receive an auger. Material moving up the cutting edge and pushing against a diverter requires greater force to load the scraper. Apparatus having a substantially smooth inclined surfaces are provided for moving material into the bowl past a compaction zone onto the spiral flight of an auger and also block incoming material from the compaction zone and lodging between the leading edge of the auger and the bowl floor.

5 Claims, 3 Drawing Figures

MATERIAL DIRECTING DEVICE FOR AN AUGER SCRAPER

DESCRIPTION

1. Technical Field

This invention relates generally to an auger scraper and more particularly to a device for maintaining the auger free of rocks, debris and the like which could restrict the rotation of the auger.

2. Background Art

Scrapers are used to load and transport large volumes of earth or other material. A scraper typically has a cutting edge for cutting through the material and a bowl for holding and transporting the cut material. To effectively utilize the loading of the scraper, an auger is provided to lift and distribute the material as it enters the bowl. Such auger scrapers are disclosed in U.S. Pat. No. 3,857,190 which issued on Dec. 31, 1974 to James E. Gee and Robert N. Stedman and in U.S. Pat. No. 4,167,825 which issued on Sept. 18, 1979 to James E. Gee, Edward J. Ohms and Craig W. Riediger.

In U.S. Pat. No. 3,857,190 the leading edge of the auger is positioned close to the bowl floor to reduce the possibility of material being lodged between the auger and floor. However, the leading edge of the auger extends outwardly over the bowl cutting edge. As the auger rotates, material such as large rocks and other debris is met by the leading edge and is sometimes trapped in a compaction zone between the leading edge and the bowl floor. The leading edge pushes the material and traps it in the compaction zone which sometimes damages the leading edge or stops the rotation of the auger. The trapped material has to be removed before the loading can continue.

It is therefore desirable to have an auger scraper which diverts cut material away from the compaction zone which exists between the floor and auger and which prevents material from lodging between the leading edge of the auger and bowl floor without interfering with the effectiveness of the auger.

In U.S. Pat. No. 4,167,825 an apparatus is disclosed for diverting incoming material and preventing the lodging of material between the auger and the bowl floor during rotational movement of the auger relative to the bowl floor. This diverter, however, requires incoming material to change direction when contacting the diverter which provides some resistance to the flow of material up the cutting edge into the scraper bowl. On higher horsepower auger scrapers, where there is sufficient power to overcome the resistance that may occur as the material moves up the cutting edge, the diverter has functioned well. But in lower horsepower auger scrapers, it would be preferred to eliminate this resistance.

Accordingly, what is needed is a device which will minimize the resistance to material flow and direct the material up a substantially uniform inclined path past the compaction zone and onto the auger for distribution into the bowl.

The present invention is directed to overcoming the problems as set forth above.

DISCLOSURE OF THE INVENTION

In one aspect of the invention, a material directing device for an auger scraper is provided. The scraper includes a material receiving bowl providing a floor terminating at a forward end of the bowl with a screw auger rotatably mounted in substantially vertically disposed or upstanding relation within the bowl. The auger has a spiral flight providing a lower leading edge located in closely spaced relation to the bowl floor and in overhanging relation to the forward end of the bowl defining a material compaction zone between the lower leading edge of the auger and the bowl floor as the leading edge sweeps along the forward end of the bowl and rearwardly into the bowl. The material directing device includes a cutting edge and a structure for mounting the cutting edge in a forwardly spaced longitudinally aligned relation to the auger. The structure includes a guide apparatus for directing material uniformly upwardly past the compaction zone and onto the flight of the auger above the lower leading edge.

BEST MODE FOR CARRYING OUT THE INVENTION

Figure 1:
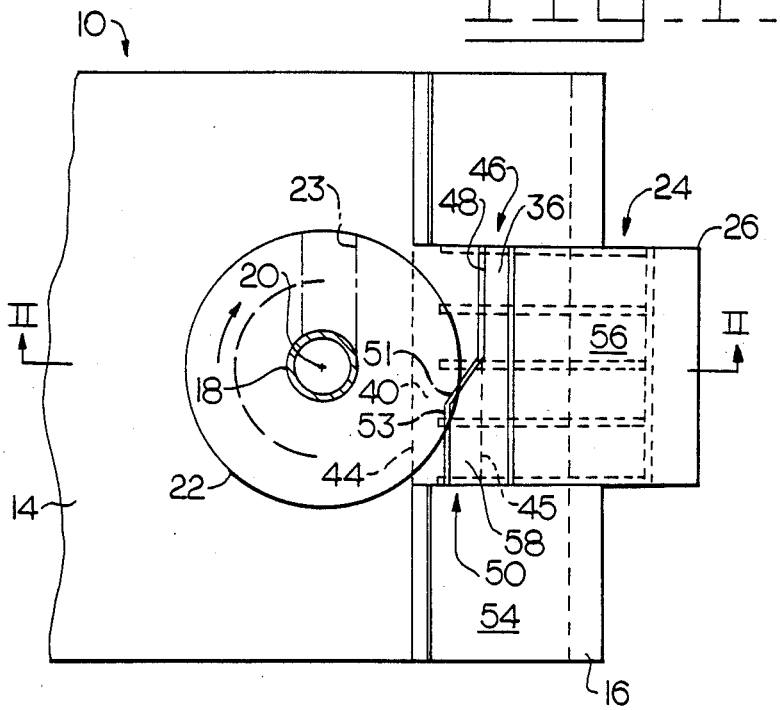
FIG. 1 is a diagrammatic top view of a portion of an auger scraper illustrating the present invention.
Figure 2:
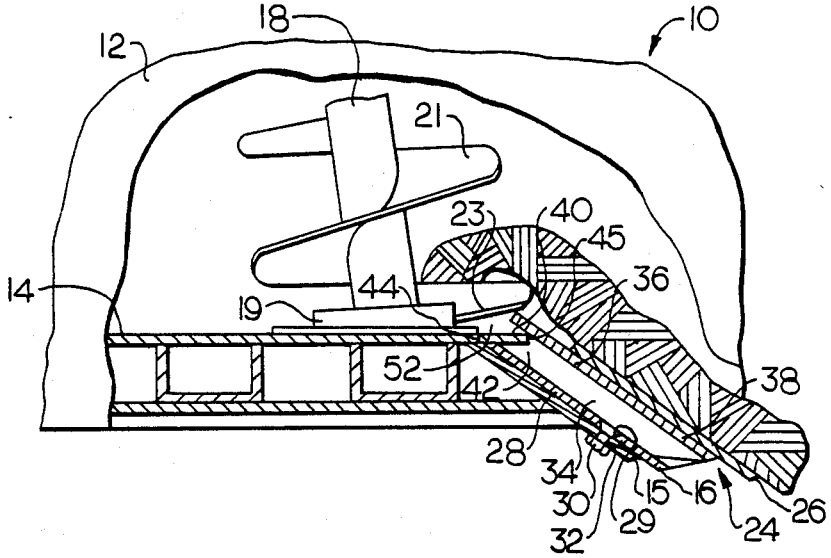
FIG. 2 is a partial sectional view taken along line II—II of FIG. 1.
Figure 3:
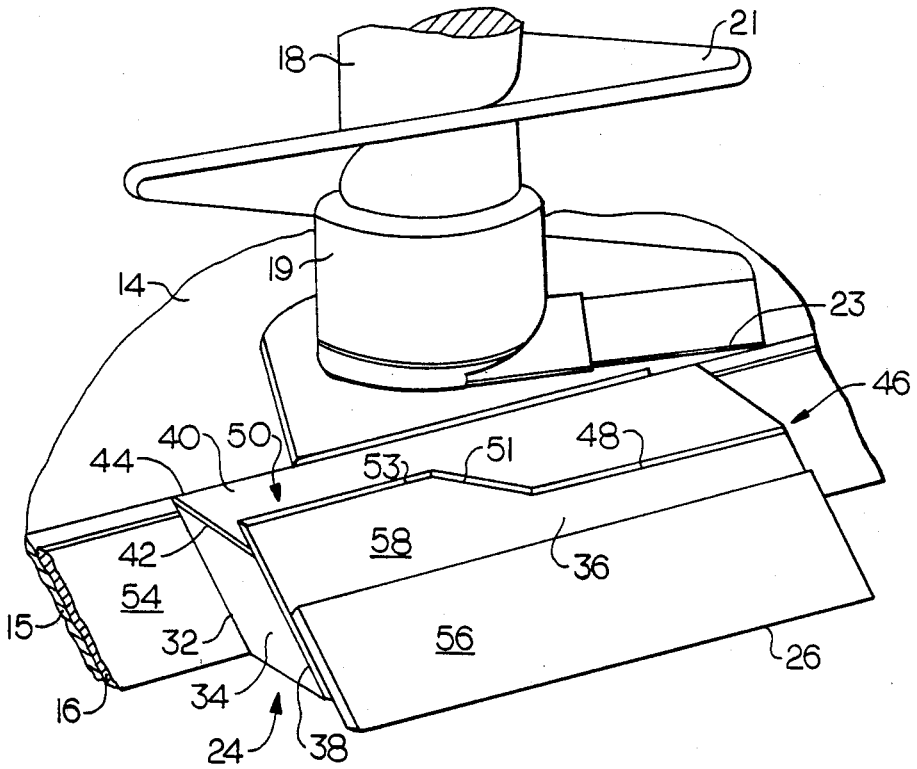
FIG. 3 is an isometric view of the present invention.

Referring to the drawings, an earthmoving scraper 10 has a material receiving bowl 12 with a floor 14, a cutting edge support 15, and a main cutting edge 16. The scraper 10 is constructed for receiving an auger 18 in a bearing 19 mounted on the floor 14 and in an upper support structure (not shown) mounted to the bowl 12. A motor (not shown) normally rotates the auger 18 about a substantially vertical axis 20. The auger 18 has a continuous spiral flight 21 having an outer periphery 22. The spiral flight 21 has a leading edge 23.

A mounting structure 24 for locating an auxiliary cutting edge 26 forward of the main cutting edge 16 is provided. A rear plate 28 of the mounting structure 24 has a plurality of holes 29 for receiving a plurality of bolts, one of which is indicated by the reference numeral 30. The rear plate 28 is bolted to the cutting edge support 15. A first edge 32 of a gusset 34 is welded to the plate 28. A front plate 36 is welded to a second edge 38 of the gusset 34. An upper plate 40 is welded between the rear plate 28 and the front plate 36, and also welded to an end 42 of the gusset. The upper plate 40 has a rearward edge 44 which abuts the bowl floor and a transversely extended forward edge 45 spaced below the leading edge 23 of the auger 18. The front plate 36 has a profiled upper border 46 including a first edge 48 that is coextensive with and on the same horizontal elevation as the bowl floor 14 and the upper plate 40. A guide apparatus or flange 50 defines an upwardly inclined transition edge or second edge 51 and a top horizontally extending edge or third edge 53 to provide the remainder of the profiled border. In the instant embodiment the guide flange extends integrally upwardly from the front plate 36 and rearwarly past the forward edge 45 of the upper plate 40 in material blocking relation to a compaction zone 52 between the leading edge 23 of the auger 18 and the bowl floor 14. The cutting edges 16,26 and front plate 36 have respective inclined surfaces 54, 56 and 58 which are parallel.

INDUSTRIAL APPLICABILITY

In operation as the scraper 10 is propelled forward, the cutting edge 16 and auxiliary cutting edge 26 cut the material. The cut material travels up the cutting edges 16, 26 toward the scraper bowl. The forward motion of the auxiliary butting edge 26 directs material upwardly and rearwardly onto the spiral flight 21 of the auger 18 to be lifted and deposited into the scraper bowl 12. Cut material moving up the surface 54 of the cutting edge 16 is free to pass on either side of the auger 18 into the scraper bowl 12.

As the auger 18 rotates and the leading edge 23 sweeps through an arc toward profiled border 46 any large material, such as rocks, which could damage the auger 18, are pushed forward and out of the way to prevent the material from lodging between the leading edge 23 and the bowl floor 14. As the leading edge 23 sweeps across profiled border 46, the guide flange 50 of the plate 36 blocks the large material from the compaction zone and lodging between the leading edge 23 of the auger 18 and the bowl floor 14.

Thus, the present invention has less resistance to material flow by moving material up a substantially uniform surface into the bowl 12.

The present invention also moves incoming material past the compaction zone 52 onto the spiral flight 21 of the auger 18, and also blocks large material from the compaction zone 52, to prevent material from lodging between the leading edge 23 of the auger 18 and the bowl floor 14.

Other aspects, objects and advantages can be obtained from a study of the disclosure, drawing and appended claims.

I claim:

1. A material directing device for an auger scraper including a bowl providing a floor having an elongated transversely oriented main cutting edge with at least one screw auger rotatably mounted in upstanding relation within the bowl, said auger having a spiral flight providing a lower leading edge located in closely spaced relation to said bowl floor and in overhanging relation to said main cutting edge which defines a material compaction zone between said lower leading edge of the auger and said bowl floor as the leading edge sweeps along the main cutting edge and rearwardly into the bowl, the material directing device comprising;

an auxiliary cutting edge; and mounting structure means for supporting said auxiliary cutting edge in forwardly spaced longitudinally aligned relation to said auger and in parallel forwardly located relation to said main cutting edge, said mounting structure means defines a guiding surface for directing material uniformly upwardly in parallel relation to said cutting edge past said compaction zone located between the leading edge of the auger and the bowl floor, and onto the flight of the auger above said lower leading edge of the auger.

2. The material directing device of claim 2 in which said mounting structure means has an upper plate which provides an extension of said bowl floor.

3. The material directing device of claim 2 wherein said support frame includes a front plate supporting said auxiliary cutting edge and has a profiled upper border including an edge coextensive with said forwarad edge of said top plate; and a material guiding flange of the front plate extending upwardly above said top plate in material blocking relation to said compaction zone beneath the auger.

4. The material directing device of claim 3 in which said upper edge of said front plate coextensive with the forward edge of said top plate is located immediately ahead of the forwardly rotating portion of the auger flights, and said guide flange is disposed immediately ahead of said rearwardly rotating portion of the auger flights to preclude ingress of material into said compaction zone.

5. A material directing device for an auger scraper comprising:

a bowl;

a bowl floor;

an auger, said auger having a continuous spiral flight having a predetermined outer periphery with a leading edge;

a main cutting edge;

an auxiliary cutting edge;

a compaction zone defined between said leading edge of the auger and said bowl floor; and a mounting structure locating said auxiliary cutting edge in forwardly spaced longitudinally aligned relation to said auger said mounting structure has a bowl floor extension and a material guiding means which extends above said bowl floor extension for guiding material uniformly upwardly past said compaction zone onto said flight of the auger and blocking material from entering said compaction zone.

* * * * *